US007792459B2

(12) United States Patent
Okabe

(10) Patent No.: US 7,792,459 B2
(45) **Date of Patent: *Sep. 7, 2010**

(54) IMAGE FORMING DEVICE AND DETACHABLY LOADED PROCESS UNIT

(75) Inventor: Yasushi Okabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/081,838

(22) Filed: Apr. 22, 2008

(65) Prior Publication Data

US 2008/0247776 A1 Oct. 9, 2008

Related U.S. Application Data

(62) Division of application No. 11/508,303, filed on Aug. 23, 2006, now Pat. No. 7,369,791, which is a division of application No. 10/851,233, filed on May 24, 2004, now Pat. No. 7,174,117, which is a division of application No. 10/242,953, filed on Sep. 13, 2002, now Pat. No. 6,751,428.

(30) Foreign Application Priority Data

| | | |
|---|---|---|
| Sep. 13, 2001 | (JP) | 2001-277604 |
| Sep. 13, 2001 | (JP) | 2001-277605 |
| Sep. 13, 2001 | (JP) | 2001-277606 |
| Mar. 25, 2002 | (JP) | 2002-007656 |
| Mar. 25, 2002 | (JP) | 2002-007657 |

(51) Int. Cl.
*G03G 21/18* (2006.01)

(52) U.S. Cl. ..... 399/111; 399/113

(58) Field of Classification Search ..... 399/111, 399/113, 119

See application file for complete search history.

(56) References Cited

U.S. PATENT DOCUMENTS 5,353,100 A 10/1994 Ohtsuka (Continued)

FOREIGN PATENT DOCUMENTS

CN 1266207 A 9/2000

(Continued)

OTHER PUBLICATIONS

U.S. Appl. No. 09/612,368, filed Jul. 2000, Deguchi et al.

(Continued)

*Primary Examiner*—William J Royer
(74) *Attorney, Agent, or Firm*—Oliff & Berridge, PLC

(57) ABSTRACT

A developing unit is detachably mounted on a photosensitive unit to form a combined unit called a process unit. In use, the process unit is loaded into an electrophotographic image forming device. A rotational shaft of a photosensitive drum projects out from the photosensitive unit. When the process unit is loaded into the image forming device from a top open space, both ends of the rotational shaft are engaged with a pair of guides formed in side walls of the image forming device and guided down along the guides. The process unit is accommodated in an accommodating section when both ends of the rotational shaft have been brought into abutment with stops at the ends of the guides and a trailing end of the process unit is rotated downward about the rotational shaft.

17 Claims, 11 Drawing Sheets

U.S. PATENT DOCUMENTS

| | | | |
|---|---|---|---|
| 6,041,203 | A | 3/2000 | Suzuki et al. |
| D422,304 | S | 4/2000 | Suzuki et al. |
| D423,559 | S | 4/2000 | Suzuki et al. |
| 6,061,538 | A | 5/2000 | Arimitsu et al. |
| 6,101,350 | A | 8/2000 | Suzuki et al. |
| 6,195,522 | B1 | 2/2001 | Sato |
| 6,219,505 | B1 | 4/2001 | Sato et al. |
| D442,216 | S | 5/2001 | Kimura et al. |
| D447,511 | S | 9/2001 | Kimura et al. |
| 6,304,735 | B1 | 10/2001 | Nishimura et al. |
| 6,321,050 | B1 | 11/2001 | Sato et al. |
| 6,330,410 | B1 | 12/2001 | Okabe et al. |
| 6,336,014 | B1 | 1/2002 | Sato et al. |
| 6,337,956 | B1 | 1/2002 | Sato et al. |
| 6,356,723 | B1 | 3/2002 | Sato et al. |
| 6,385,414 | B1 | 5/2002 | Sato et al. |
| 6,411,789 | B1 | 6/2002 | Okabe et al. |
| 6,456,810 | B1 | 9/2002 | Deguchi et al. |
| 6,496,668 | B2 | 12/2002 | Sato et al. |
| 6,496,669 | B2 | 12/2002 | Sato et al. |
| 6,512,904 | B2 | 1/2003 | Sato et al. |
| 6,546,217 | B2 | 4/2003 | Okabe et al. |
| 6,751,428 | B2 | 6/2004 | Okabe |
| 7,174,117 | B2 | 2/2007 | Okabe |
| 7,245,850 | B2 | 7/2007 | Okabe et al. |
| 7,369,791 | B2 * | 5/2008 | Okabe ..... 399/111 |
| 7,509,071 | B2 * | 3/2009 | Yoshimura et al. ..... 399/111 |
| 7,512,361 | B2 * | 3/2009 | Kawamura et al. ..... 399/111 |

FOREIGN PATENT DOCUMENTS

| | | |
|---|---|---|
| JP | A 5-281854 | 10/1993 |
| JP | A 6-222629 | 8/1994 |
| JP | A 8-185108 | 7/1996 |
| JP | A 8-248857 | 9/1996 |

OTHER PUBLICATIONS

U.S. Appl. No. 09/953,124, filed Sep. 2001, Sato et al.
U.S. Appl. No. 10/053,908, filed Jan. 2002, Sato et al.
U.S. Appl. No. 09/935,595, filed Aug. 2001, Sato et al.
U.S. Appl. No. 10/153,643, filed May 2002, Okabe et al.

* cited by examiner

IMAGE FORMING DEVICE AND DETACHABLY LOADED PROCESS UNIT

This is a Division of application Ser. No. 11/508,303 filed Aug. 23, 2006, which is a Division of application Ser. No. 10/851,233 filed May 24, 2004, now U.S. Pat. No. 7,174,117, which is a Division of application Ser. No. 10/242,953 filed Sep. 13, 2002, now U.S. Pat. No. 6,751,428, which claims foreign priority from the following Japanese Patent Applications: JP 2001-277604 filed Sep. 13, 2001, JP 2001-277605 filed Sep. 13, 2001, JP 2001-277606 filed Sep. 13, 2001, JP 2002-7656 filed Mar. 25, 2002 and JP 2002-7657 filed Mar. 25, 2002. The entire disclosure of the prior applications are hereby incorporated by reference herein in their entirety.

BACKGROUND

1. Field of the Invention

The present invention relates to an electrophotographic image forming device, such as a laser beam printer, a copying machine, or a facsimile device. More particularly, the invention relates to a process unit detachably loaded into the image forming device and a structure of the image forming device for receiving and accommodating the process unit.

2. Description of the Related Art

Conventional image forming devices, such as a laser beam printer, use a process unit. The process unit is, for example, a combined unit of a photosensitive unit and a developing unit. The photosensitive unit includes a photosensitive drum and a charger. The developing unit includes a developing roller and a toner cartridge containing developing agent (toner) therein.

During a printing operation, the developing roller is urged against the photosensitive drum, so that the developing roller transfers toner onto the photosensitive drum. Also, a transfer roller is urged against the photosensitive drum.

For the sake of maintenance and for facilitating paper jam removal, the process unit is detachably mounted on the image forming device. That is, the process unit is unloaded from and loaded into the image forming device when a paper jam occurs, for example.

U.S. Pat. No. 6,101,350 proposes horizontally loading the process unit. The horizontally loading type requires a locking mechanism to prevent the loaded process unit from being accidentally detached. In order to withstand a strong detaching force imparted upon the process unit, a rigid locking mechanism is needed. However, the image forming device cannot be structurally simplified and made compact in size and also the cost of the image forming device cannot be lowered if the rigid locking mechanism is employed.

SUMMARY

The present invention has been made to solve the aforementioned problems, and accordingly it is an object of the invention to provide an image forming device and a process unit in which the process unit can be easily loaded into the image forming device and the process unit thus loaded cannot be easily detached.

Another object of the invention is to provide a process unit in which a developing unit can be easily mounted on and dismounted from a photosensitive unit.

Still another object of the invention is to provide an image forming device that has a simple structure for receiving a process unit and urging a developing roller against a photosensitive drum once the process unit is received and accommodated in a process unit accommodating section.

To achieve the above and other objects, there is provided, according to one aspect of the invention, an image forming device that includes a housing, a pair of first guides, a process unit, a process unit accommodating section, and a second guide. The first guides extend down to terminals. The process unit has a bottom wall and side walls. The side walls are formed with protrusions protruding outward. The protrusions are engageable with the first guides, and guided down along the first guides toward the terminals when the process unit is loaded into the housing.

The process unit accommodating section is provided for receiving and accommodating the process unit. The second guide is formed between the first guides for guiding the bottom surface of the process unit from a top open space of the housing toward the terminals. The process unit is accommodated in the process unit accommodating section when the protrusions of the process unit have been brought into abutment with the terminals and a trailing end of the process unit is rotated downward about an imaginary line connecting the protrusions.

With the image forming device thus constructed, the process unit can be easily accommodated in the process unit accommodating section. This can be done by engaging the protrusions with the first guides and placing the process unit on the second guide. When the protrusions formed in the process unit are brought into abutment with the terminals, the trailing end of the process unit is automatically rotated downward due to its own weight and accommodated into the process unit accommodating section. Also, the process unit can be easily unloaded from the image forming device by lifting the trailing end of the process unit, placing it on the second guide, and moving up along the second guide.

A posture maintaining member may be formed on the process unit for maintaining a posture of the process unit when accommodated in the process unit accommodating section.

Preferably, the first guides are in the form of an elongated U-shaped groove into which the protrusions are inserted, and the second guide is in the form of a rail having an upper flat surface on which the process unit slidably moves.

A locking mechanism may further be provided for locking the process unit to the housing. It is desirable that the locking mechanism be provided in the process unit accommodating section. The locking mechanism may be constructed to resiliently engage the trailing end of the process unit.

The process unit includes a photosensitive unit and a developing unit. The developing unit is detachably mounted on the photosensitive unit. The photosensitive unit includes a photosensitive drum, and the developing unit includes a developing roller. The protrusions are provided to the photosensitive unit. The rotational shaft of the photosensitive drum may be provided to project from the photosensitive unit. In such a case, the projected portions of the rotational shaft may be used as the protrusions.

A latching mechanism may be further provided for latching the process unit to the process unit accommodating section.

The process unit includes a photosensitive drum and developing roller. It is desirable that the process unit is accommodated in the process unit accommodating section while being urged toward a predetermined direction to urge the developing roller against the photosensitive drum The process unit may be formed with auxiliary guide members for determining a loading direction and unloading direction of the process unit when loading into and unloading from the housing.

It is desirable that the developing unit have a bottom surface on which a first posture maintaining member is formed for maintaining a posture of the developing unit when mounted on the photosensitive unit and that the photosensitive unit have a bottom surface on which a second posture maintaining member is formed for maintaining a posture of the photosensitive unit when accommodated in the process unit accommodating section. Preferably, the first posture maintaining member and the second posture maintaining member are mated with each other.

According to another aspect of the invention, there is provided an image forming device that includes a housing, a process unit, a process unit accommodating section, and developing roller moving mechanism. The housing has a pair of upstanding walls each formed with a first guide extending to a first terminal. The process unit is detachably mounted on the housing. The process unit includes a photosensitive unit and a developing unit. The photosensitive unit has at least a photosensitive drum and first protrusions. The first protrusions are engageable with the first guides. The first protrusions are guided down along the first guides toward the first terminals when the process unit is loaded into the housing. The developing unit has at least a developing roller. The process unit accommodating section is provided for receiving and accommodating the process unit. The process unit is accommodated therein when a trailing end of the process unit is rotated downwardly about an imaginary line connecting the first protrusions that are located in the first terminals. The developing roller moving mechanism is provided for moving the developing roller toward the photosensitive drum. At this time, the developing roller is urged against the photosensitive drum.

With the image forming device thus constructed, when the developing roller is urged against the photosensitive drum by the developing roller moving mechanism, the photosensitive unit is also urged in the same direction in which the developing roller is urged and thus can be set to a predetermined position.

The photosensitive unit is detachably mountable in the process unit accommodating section when the photosensitive unit is loaded into the housing from a top open space of the housing. Also, the developing unit is detachably mountable on the photosensitive unit mounted in the process unit accommodating section. Accordingly, exchange of the developing unit can be easily performed.

It is desirable that the developing unit be formed with an engagement protrusion. The engagement protrusion is brought into engagement with the developing roller moving mechanism when the process unit is accommodated in the process unit accommodating section.

The developing unit has a second protrusion. Also, a guide groove is formed in the photosensitive unit. The guide groove extends to a second terminal near the first terminals and guides the second protrusion to the second terminal. When a trailing end of the developing unit is rotated downward when the second protrusion is located in the second terminal, then the engagement protrusion is brought into engagement with the developing roller moving mechanism.

A separation mechanism may further be provided for moving the developing roller away from the photosensitive drum. Also, a nipping mechanism may further be provided for nipping the engagement protrusion. The developing roller moving mechanism and the separation mechanism may be used as the nipping mechanism.

Alternatively, the nipping mechanism may include a first nipping member having a first movable end, and a second nipping member having a second movable end. The engagement protrusion is nipped when the first movable end and the second movable end move toward each other. An open space is provided between the first movable end and the second movable end when the first movable end and the second movable end move away from each other. Accordingly, the nipping mechanism can easily grasp the engagement protrusion when the developing unit is downwardly moved. The developing roller moving mechanism may include an urging member that urges the first nipping member toward the second nipping member to thereby urge the developing roller against the photosensitive drum. The separation mechanism may include a moving member that moves the second nipping member toward the first nipping member to thereby move the developing roller away from the photosensitive drum.

It is desirable that each of the side walls of the developing unit be formed with the engagement protrusion. In this case, the developing roller moving mechanism and the separation mechanism are provided at each side of the pair of upstanding walls so as to engage the engagement protrusion formed in each side wall of the developing unit.

It is further desirable that the housing be formed with a pair of second guides between the first guides for guiding the process unit from the top open space of the housing toward the process unit accommodating section.

The first guide may be a rotational shaft of the photosensitive drum and the second guide may be a rotational shaft of the developing roller.

According to a further aspect of the invention, there is provided an image forming device that includes a housing, a photosensitive unit, a developing unit, a pair of first guides, a photosensitive unit accommodating section, and a pair of guide grooves. The housing has first side walls. The photosensitive unit has second side walls. The developing unit has third side walls. Further, the photosensitive unit has a photosensitive drum and a first guide shaft projecting out from the second side walls. The developing unit has a developing roller and a second guide shaft projecting out from the third side walls. The developing unit is detachably mounted on the photosensitive unit.

Each first guide is formed in each first side wall and extends to a first terminal. The first guide serves to guide the first guide shaft therealong to the first terminal when the photosensitive unit is loaded into the housing from a top open space of the housing.

The photosensitive unit accommodating section is provided for receiving and accommodating the photosensitive unit. The photosensitive unit is accommodated therein when a trailing end of the photosensitive unit is rotated downward about the first guide shaft located in the first terminals.

Each guide groove is formed in each second side wall and extends to a second terminal. The guide groove guides the second guide shaft therealong to the second terminal. The photosensitive unit has a developing unit mounting section for mounting the developing unit. The developing unit is mounted thereon when it is loaded into the housing from the top open space of the housing along the guide grooves to the second terminals. The first guides are formed substantially in parallel to the guide grooves.

According to the image forming device thus constructed, the developing unit can be mounted on or dismounted from the photosensitive unit regardless of whether the photosensitive unit is loaded into or unloaded from the image forming device. Further, the combined unit in which the developing unit is mounted on the photosensitive unit can be easily loaded into or unloaded from the image forming device.

It is desirable that the photosensitive unit be provided with a locking mechanism for locking the developing unit mounted on the developing unit mounting section of the photosensitive unit. Preferably, the locking mechanism is provided to a rear wall of the photosensitive unit. Accordingly, when the developing unit is locked to the photosensitive unit with the locking mechanism, both the photosensitive unit and the developing unit can be carried and moved by grasping only the photosensitive unit or the developing unit. The developing unit can easily be dismounted from the photosensitive unit merely by unlocking the locking mechanism.

The locking mechanism has a locking position for locking the developing unit to the photosensitive unit accommodated in the photosensitive unit accommodating section and an unlocking position for unlocking the developing unit from the photosensitive unit accommodated in the photosensitive unit accommodating section. As such, the developing unit can be easily mounted on and dismounted from the photosensitive unit while leaving the photosensitive unit in the photosensitive unit accommodating section.

The developing unit is pivotally movable about the second guide shaft when both end portions of the second guide shaft are located in the second terminals. Accordingly, the developing unit can be easily mounted on and dismounted from the photosensitive unit by grasping the rear end of the developing unit, orienting the second guide shaft downward, and moving the second guide shaft along the guide grooves formed in the photosensitive unit. In this case, the photosensitive unit may be accommodated in the photosensitive unit accommodating section or may be unloaded from the image forming device and placed outside the image forming device.

An urging mechanism may further be provided for urging the developing roller against the photosensitive drum. By slidably moving the first guide shaft of the photosensitive unit along the first guides, the photosensitive unit is automatically accommodated in the photosensitive unit accommodating section due to its own weight when the first guide shaft is brought into abutment with the first terminals. Once the photosensitive unit is accommodated in the photosensitive unit accommodating section, the photosensitive unit is not allowed to shift horizontally. Therefore, the photosensitive unit cannot be easily taken out from the loaded position. In this condition, when the developing unit is mounted on the photosensitive unit, the urging mechanism urges the developing unit so that the developing roller is urged against the photosensitive drum. This means that the photosensitive unit is also urged by the urging mechanism and is set to a predetermined position.

The first guide shaft may be a rotational shaft of the photosensitive drum and the second guide shaft a rotational shaft of the developing roller. In this case, a center of the second guide shaft is substantially located on an imaginary line connecting a center of the first guide shaft and a point where the urging mechanism urges the developing unit.

Because the first guides are formed substantially in parallel to the guide grooves and also because there is the geometric relationship as described above, the loading of the photosensitive unit and mounting of the developing unit on the loaded photosensitive unit can be performed substantially in the same fashion.

The developing unit may be formed with an engagement protrusion. The engagement protrusion is brought into engagement with the urging mechanism when a trailing end of the photosensitive unit with the developing unit mounted on the developing unit mounting section is rotated about the first guide shaft located in the first terminals.

With such an arrangement, the engagement protrusion formed in the developing unit is automatically brought into engagement with the urging mechanism simply by accommodating the photosensitive unit in the photosensitive unit accommodating section. As such, positioning the photosensitive unit and urging the developing roller against the photosensitive drum can be achieved with one-touch operation.

The engagement protrusion is preferably formed in each third side wall. Accordingly, the urging force imparted upon the photosensitive drum becomes uniform in its lengthwise direction.

According to a further aspect of the invention, there is provided a photosensitive unit capable of being loaded into and unloaded from an image forming device. The photosensitive unit includes a case, a photosensitive drum rotatably disposed in the case; and projections. Each projection projects out from side walls of the case. The projections are engageable with a pair of guides formed in the side walls of the case. The projections are guided down along a pair of guides formed in the case of the image forming device toward terminals. The case is accommodated in a photosensitive unit accommodating section when the projections have been brought into abutment with the terminals and a trailing end of the case is rotated downward.

According to a further aspect of the invention, there is provided a developing unit capable of being mounted on and dismounted from a photosensitive unit. The developing unit includes a case, a developing roller rotatably disposed in the case, a protrusion, and an engaging member. The protrusion projects out from a side wall of the case. The protrusion is engageable with a guide formed in the photosensitive unit. The protrusion is guided down along the guide toward a terminal. The case is mounted on a developing unit mounting section when the protrusion has been brought into abutment with the terminal and a trailing end of the case is rotated downward. The engaging member engages an urging mechanism provided in an image forming device. The urging mechanism urges the case toward the photosensitive unit when the case is mounted on the developing unit mounting section.

According to yet another aspect of the invention, there is provided a developing unit that is similar to the one described above but different therefrom in that the protrusion is guided down along the guide toward the terminal in a direction substantially in coincident with the direction in which the protrusions of the photosensitive unit are guided down along the guides formed in the side walls of the image forming device and in that a locking projection is formed in the trailing end of the case. The locking projection is engageable with a locking lever provided in the image forming device. Only the case can be dismounted from the developing unit mounting section by disengaging the locking lever from the locking projection while leaving the photosensitive unit in the image forming device.

According to yet another aspect of the invention, there are provided process unit combinations of the photosensitive unit and the developing unit described above.

BRIEF DESCRIPTION OF THE DRAWINGS

The particular features and advantages of the invention as well as other objects will become apparent from the following description taken in connection with the accompanying drawings, in which.

DETAILED DESCRIPTION OF EMBODIMENTS

A laser beam printer according to a preferred embodiment of the invention will be described with reference to the accompanying drawings. In the following description, the terms "downward", "front", "rear", "above", "below", "beneath" and the like will be used assuming that the laser beam printer is disposed in an orientation in which it is intended to be used.

Figure 1:
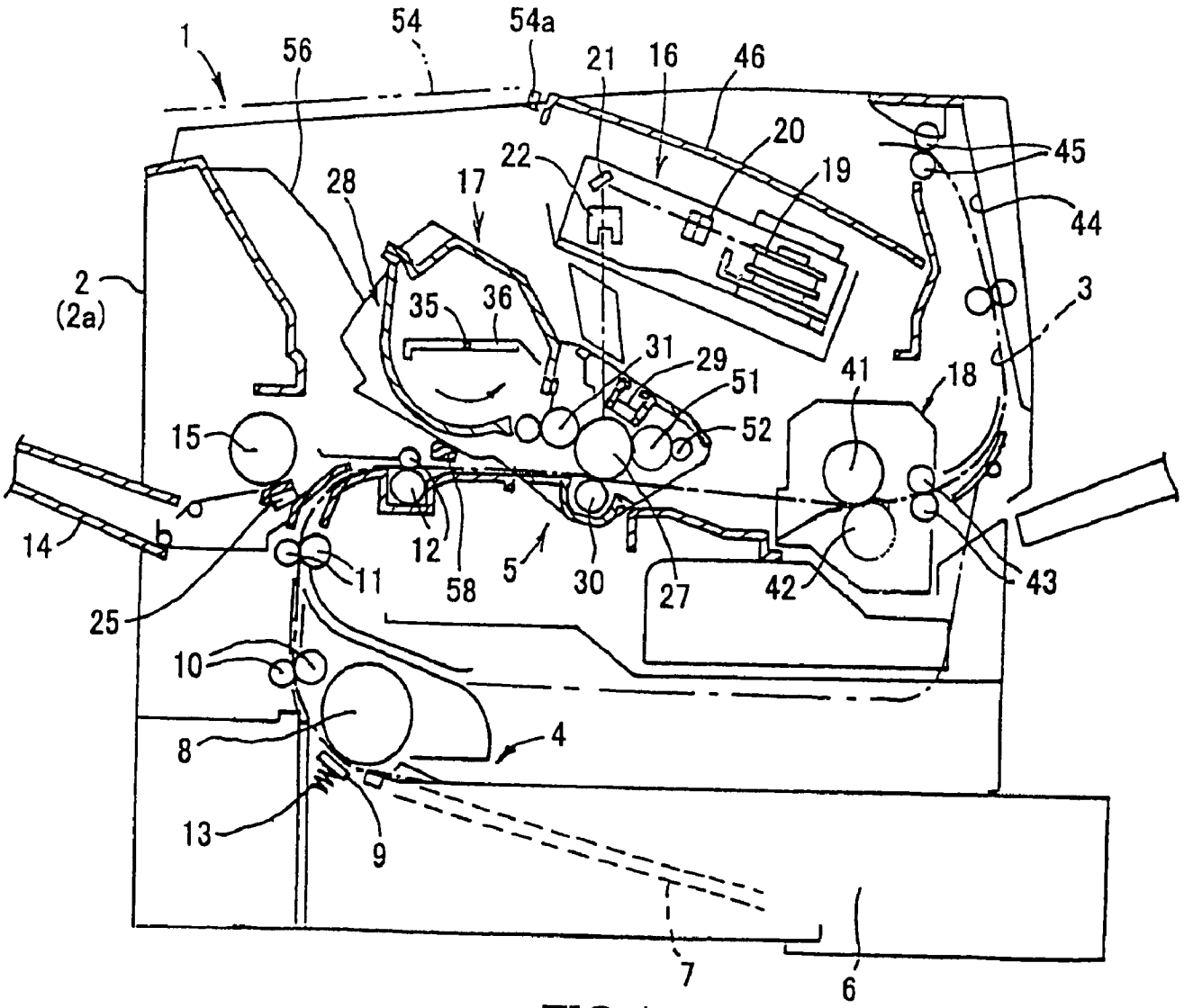
FIG. 1 is a cross-sectional view showing a laser beam printer according to an embodiment of the present invention.

FIG. 1 is a cross-sectional view showing the laser beam printer 1. As shown in this figure, the laser beam printer 1 has a housing 2 in which a sheet feed section 4 and an image forming section 5 are disposed. The image forming section 5 forms images on paper sheets supplied by the sheet feed section 4.

The sheet feed section 4 includes a sheet feed tray 6, a sheet urging plate 7, a sheet feed roller 8, a sheet feed pad 9, a pair of paper dust removing rollers 10, a pair of sheet feed rollers 11, and a pair of registration rollers 12. The sheet feed tray 6 is detachably provided on the bottom portion of the housing 2. The sheet feed roller 8 is rotatably disposed above one end of the sheet feed tray 6. The paper dust removing rollers 10 are disposed downstream from the sheet feed roller 8 with respect to a sheet transport direction in which the sheets of paper are transported. The registration rollers 12 are disposed downstream from the sheet feed rollers 11.

The sheet urging plate 7 is disposed in the sheet feed tray 6. The sheet urging plate 7 is pivotally movably supported about its end portion remote from the sheet feed roller 8 and is upwardly biased by springs (not shown) provided on the lower side of the urging plate 7. A stack of sheets 3 is adapted to be placed on the sheet urging plate 7. The free end portion of the sheet urging plate 7 moves downward against the biasing force of the springs to an extent that depends upon how many sheets of paper are stacked on the sheet urging plate 7.

The sheet feed roller 8 and the sheet feed pad 9 are disposed in confronting relation with each other. The sheet feed pad 9 is pressed against the sheet feed roller 8 by a spring 13 disposed on the rear surface of the sheet feed pad 9. The tip end of the uppermost sheet 3 stacked in the sheet feed tray 6 is pressed against the sheet feed roller 8 by the spring biasing the sheet urging plate 7 upward, is gripped by the sheet feed roller 8 and the sheet feed pad 9, and then is transported by rotation of the sheet feed roller 8. The sheet of paper fed by the sheet feed roller 8 passes through the nip between the paper dust removing rollers 10 where the paper dust removing rollers 10 remove paper dust from the sheet to a certain extent. Then, the sheet of paper is further transported by the sheet feed rollers 11 to the registration rollers 12, where the sheet of paper is subjected to registration, and then fed to the image forming section 5.

The sheet feed section 4 further includes a multi-purpose tray 14, a multi-purpose sheet feed roller 15, and a multi-purpose sheet feed pad 25. The multi-purpose sheet feed roller 15 and the multi-purpose sheet feed pad 25 supply sheets 3 that are stacked on the multi-purpose tray 14. The multi-purpose sheet feed roller 15 and the multi-purpose sheet feed pad 25 are disposed in mutual confrontation with each other. A spring disposed to the undersurface of the multi-purpose sheet feed pad 25 presses the multi-purpose sheet feed pad 25 toward the multi-purpose sheet feed roller 15. Rotation of the multi-purpose sheet feed roller 15 sandwiches sheets 3 that are stacked on the multi-purpose tray 14 between the multi-purpose sheet feed roller 15 and the multi-purpose sheet feed pad 25 and then feeds the sheets 3 one at a time to the registration rollers 12.

The image forming section 5 includes a scanner unit 16, a process unit 17, and a fixing unit 18. The scanner unit 16 is provided in the upper section of the housing 2 and includes a polygon mirror 19, lenses 20 and 22, and a reflection mirror 21. A laser source emits a laser beam modulated based on image data. As indicated by a single-dot chain line in FIG. 1, the laser beam is reflected by the rotating polygon mirror 19, passes through the lens 20, is reflected by the reflection mirror 21, and passes through the lens 22. The laser beam that has passed through the lens 22 scans across the surface of a photosensitive drum 27 in the process unit 17. The term "process unit" as used in the following description refers to a combined unit of a developing unit 28 and a photosensitive unit 26.

Figure 2:
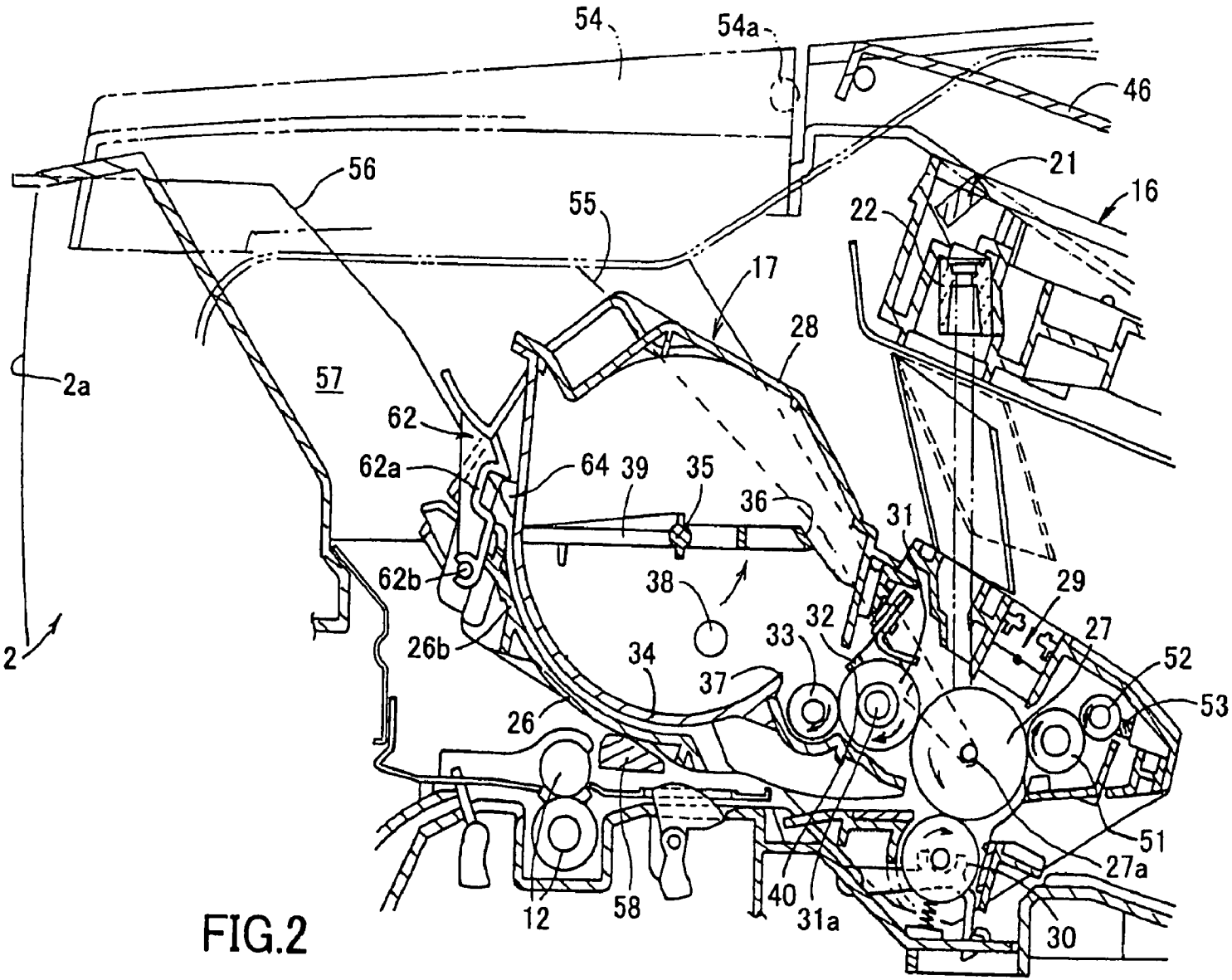
FIG. 2 is an enlarged cross-sectional view showing essential portions of a process unit of the printer shown in FIG. 1.

The process unit 17 is disposed below the scanner unit 16. As shown in FIG. 2, the process unit 17 includes the photosensitive drum 27, a scorotron charge unit 29, a transfer roller 30, a cleaning roller 51, a secondary roller 52, and a sliding member 53. These components of the process unit 17 are housed in the photosensitive unit 26, which is freely detachably mounted on the housing 2.

The laser beam printer 1 primarily uses a developing roller 31 to collect residual toner from the surface of the photosensitive drum 27. That is, the developing roller 31 collects the toner that remains on the photosensitive drum 27 after toner is transferred onto the sheet 3. As such, there is no need to provide a cleaning blade and a means for holding waste toner. Therefore, the printer can be made with a simpler configuration, more compact, and less expensive.

As best shown in FIG. 2, the photosensitive drum 27 has a rotational shaft 27*a* extending in parallel with a rotational shaft 31*a* of the developing roller 31 and is disposed in contact with the developing roller 31. The photosensitive drum 27 is rotatable in the counterclockwise direction and the developing roller 31 is rotatable in the opposite direction, i.e., clockwise direction, as indicated by arrows in FIG. 2. The photosensitive drum 27 includes a drum connected to ground and a photosensitive layer covering the outer surface of the drum. The photosensitive layer is made from a material selected from an amorphous silicon group, such as $\alpha$-Si:H, from a cadmium sulfide group, such as CdS, from a zinc oxide group, such as ZnO, from a selenium group, such as selen, or is made from organic photosensitive materials, such as polycarbonate. Such photosensitive materials have a property to be positively charged.

Figure 3:
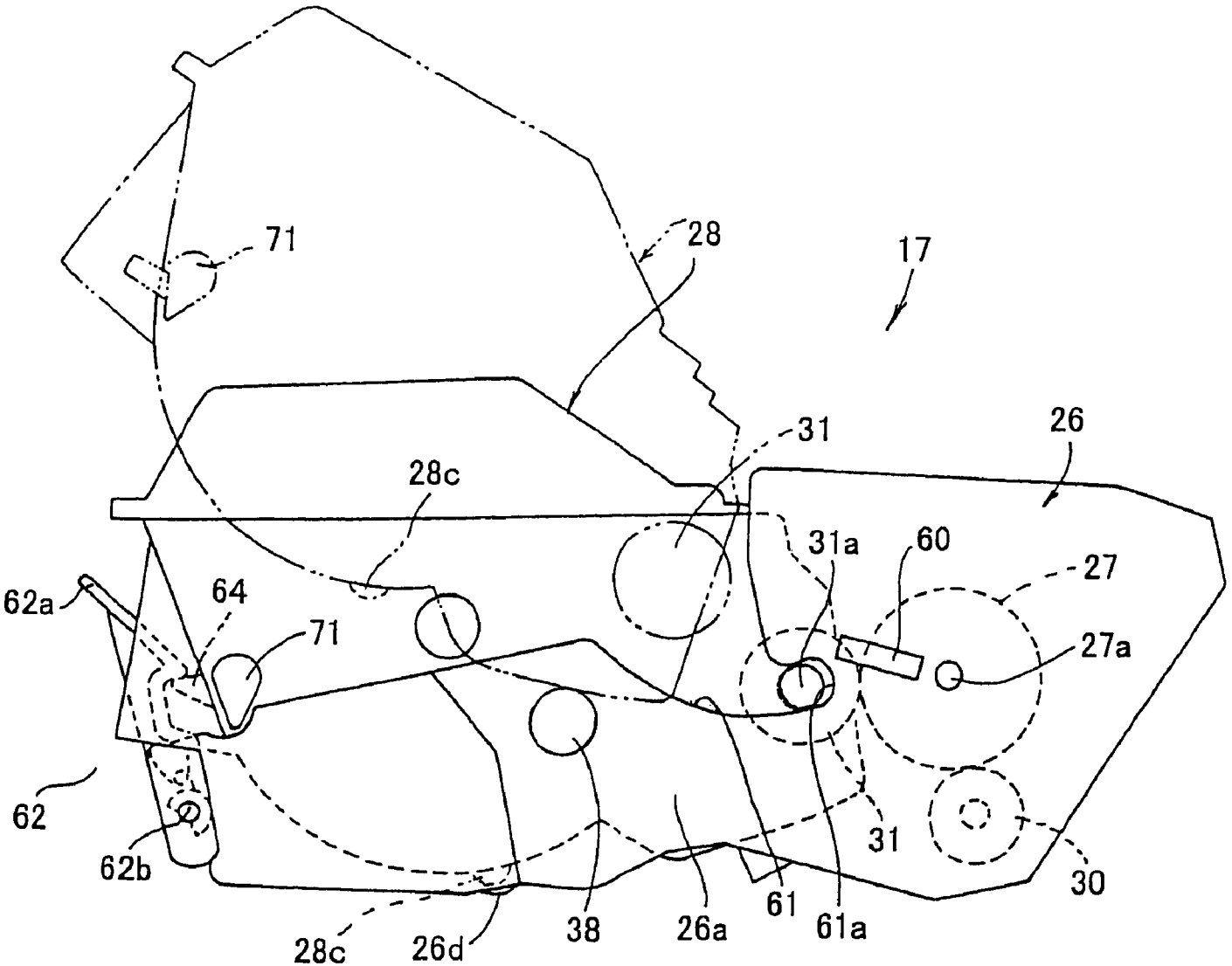
FIG. 3 is a side view showing a process of combining a developing unit to a photosensitive unit.
Figure 4:
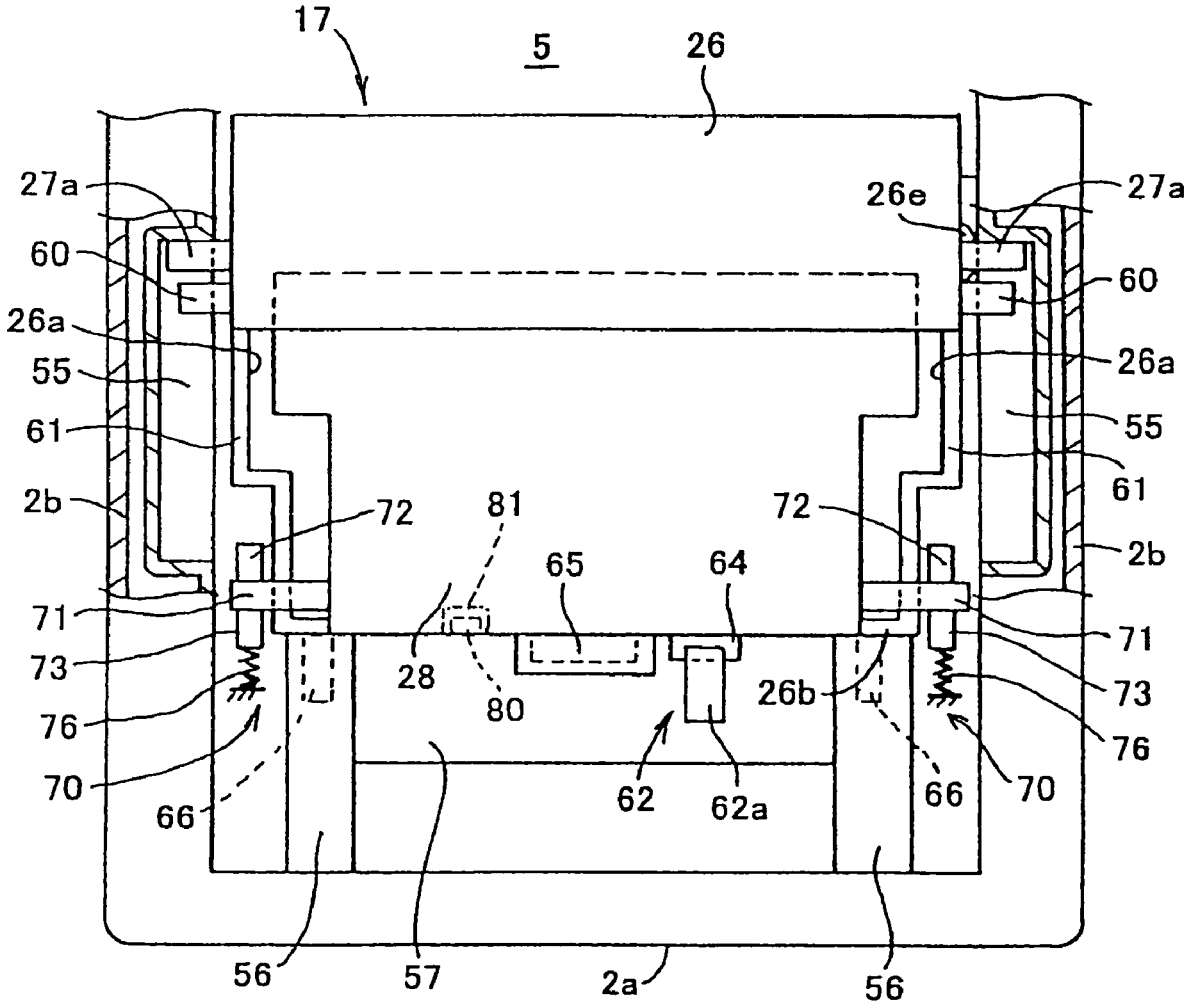
FIG. 4 is a plan view showing a process unit receiving portion.

As shown in FIGS. 3 and 4, the rotational shaft 27*a* of the photosensitive drum 27 extends outwardly from the photosensitive unit 26 and is rotated by a main motor (not shown).

The scorotron charge unit 29 is disposed above the photosensitive drum 27 and separated from the photosensitive drum 27 by a predetermined distance so as not to contact the photosensitive drum 27. The scorotron charge unit 29 is of a positively-charging type that generates a corona discharge from a charge wire made from tungsten, for example. The scorotron charge unit 29 uniformly charges the surface of the photosensitive drum 27 to a positive polarity. The scorotron charge unit 29 is turned ON and OFF by a charge power source (not shown).

In association with rotation of the photosensitive drum 27, the surface of the photosensitive drum 27 is uniformly charged to a positive polarity by the scorotron charge unit 29, and is then exposed to light by the laser beam. The laser beam is emitted from the scanner unit 16 while being modulated by image data and scanned in the widthwise direction of the photosensitive drum 27 at a high speed. As a result of exposure by the laser beam, an electrostatic latent image is formed on the surface of the photosensitive drum 27.

The transfer roller 30 is disposed below the photosensitive drum 27 while contacting the photosensitive drum 27. The transfer roller 30 is supported on the photosensitive unit 26 so as to be rotatable in the clockwise direction as indicated by an arrow in FIG. 2. The transfer roller 30 consists of a metal roller and an ion conductive rubber material covering the metal roller. A transfer bias application power source applies a forward bias to the transfer roller 30 when toner is to be transferred from the photosensitive drum 27. The visible toner image on the surface of the photosensitive drum 27 is transferred onto a sheet 3 when the sheet 3 passes between the photosensitive drum 27 and the transfer roller 30.

The developing unit 28 is detachably mounted to the photosensitive unit 26. The developing unit 28 includes the developing roller 31, a layer-thickness regulating blade 32, a supply roller 33, and a toner box 34.

The toner box 34 is filled with non-magnetic single-component toner having a positively charging nature. In the present example, the toner filling the toner box 34 is a polymer toner obtained by co polymerization of a monomer with a polymerizing nature. The co polymerization can be performed by a well-known polymerization method such as suspension polymerization. Examples of monomers that can be used include a styrene monomer, such as styrene, or an acrylic monomer, such as acrylic acid, alkyl (C1-C4) acrylate, and alkyl (C1-C4) meta acrylate. The polymer toner particles are spherical so that the toner has extremely high fluidity. Also, coloring agents, such as carbon black, and wax are dispersed in the toner. Also, an external additive such as silica is added to increase fluidity of the polymer toner. The toner particles have a particle size of between about 6 to 10 micrometers.

A rotation shaft 35 is provided in the center of the toner box 34. An agitator 36 is supported on the rotation shaft 35. The agitator 36 rotates in the counterclockwise direction as indicated by an arrow in FIG. 1. This stirs up the toner in the toner box 34 and also pushes the toner out through a toner supply opening 37 that is opened in the side of the toner box 34. A window 38 is formed in the side wall of the toner box 34. The window 38 is provided for detecting how much toner remains in the toner box 34. Also, a cleaner 39 is supported on the rotation shaft 35 for cleaning the window 38.

The supply roller 33 is disposed at the side of the toner supply opening 37. The supply roller 33 is rotatable in the clockwise direction as indicated by an arrow in FIG. 2. The developing roller 31 is disposed in confrontation with the supply roller 33 and is rotatable in the clockwise direction as indicated by an arrow in FIG. 2. The supply roller 33 and the developing roller 31 abut against each other so that each is compressed by a certain extent.

The supply roller 33 is a conductive foam roller that covers a metal roller shaft. The developing roller 31 is a conductive rubber roller that covers a metal roller shaft. More specifically, the foam roller portion of the developing roller 31 includes a roller body with a coat layer covering its surface. The roller body is made from conductive silicone rubber or urethane rubber including carbon particles. The coat layer is silicon rubber or urethane rubber including fluoride. The developing roller 31 is applied with a developing bias by a developing bias application power source (not shown).

The layer-thickness regulating blade 32 is disposed in the vicinity of the developing roller 31. The layer-thickness regulating blade 32 includes a blade body and a pressing portion 40. The blade body is made from a metal leaf spring. The pressing portion 40 is provided on the free tip of the blade body. The pressing portion 40 is dome-shaped in cross-section and is made from silicone rubber with electrically insulating properties. The layer-thickness regulating blade 32 is supported on the developing unit 28 at a position near the developing roller 31. The resilient force of the blade body presses the pressing portion 40 against the surface of the developing roller 31.

The toner pushed out from the toner supply opening 37 is supplied to the developing roller 31 by rotation of the supply roller 33. The toner is charged to a positive polarity by friction between the supply roller 33 and the developing roller 31. As the developing roller 31 rotates, the toner on the developing roller 31 enters between the developing roller 31 and the pressing portion 40 of the layer-thickness regulating blade 32. The toner is further charged by friction between the developing roller 31 and the layer-thickness regulating blade 32 and regulated into a thin layer of uniform thickness on the developing roller 31.

When rotation of the developing roller 31 brings the positively charged toner borne on the developing roller 31 into confrontation with and contact with the photosensitive drum 27, the toner selectively clings to the electrostatic latent image on the surface of the photosensitive drum 27, thereby developing the electrostatic latent image into a visible toner image. As a result, inverse development is achieved.

As shown in FIG. 1, the fixing unit 18 is disposed at the downstream side of the process unit 17. The fixing unit 18 includes a thermal roller 41, a pressing roller 42, and a pair of transport rollers 43. The pressing roller 42 presses against the thermal roller 41. The transport rollers 43 are disposed at the downstream side of the thermal roller 41 and the pressing roller 42. The thermal roller 41 is made from metal and includes a halogen lamp for heating up. After toner is transferred onto a sheet 3 in the process unit 17, the sheet 3 passes between the thermal roller 41 and the pressing roller 42. Heat from the thermal roller 41 melts and fixes the toner onto the sheet 3. Afterward, the transport rollers 43 transport the sheet 3 to a discharge path 44. The sheet 3 transported to the discharge path 44 is transported to sheet-discharge rollers 45 and discharged onto a sheet-discharge tray 46.

Referring next to FIGS. 3, 4 and 9-11, description will be made with respect to mounting the developing unit 28 on and dismounting the developing unit 28 from the photosensitive unit 26.

Figure 9:
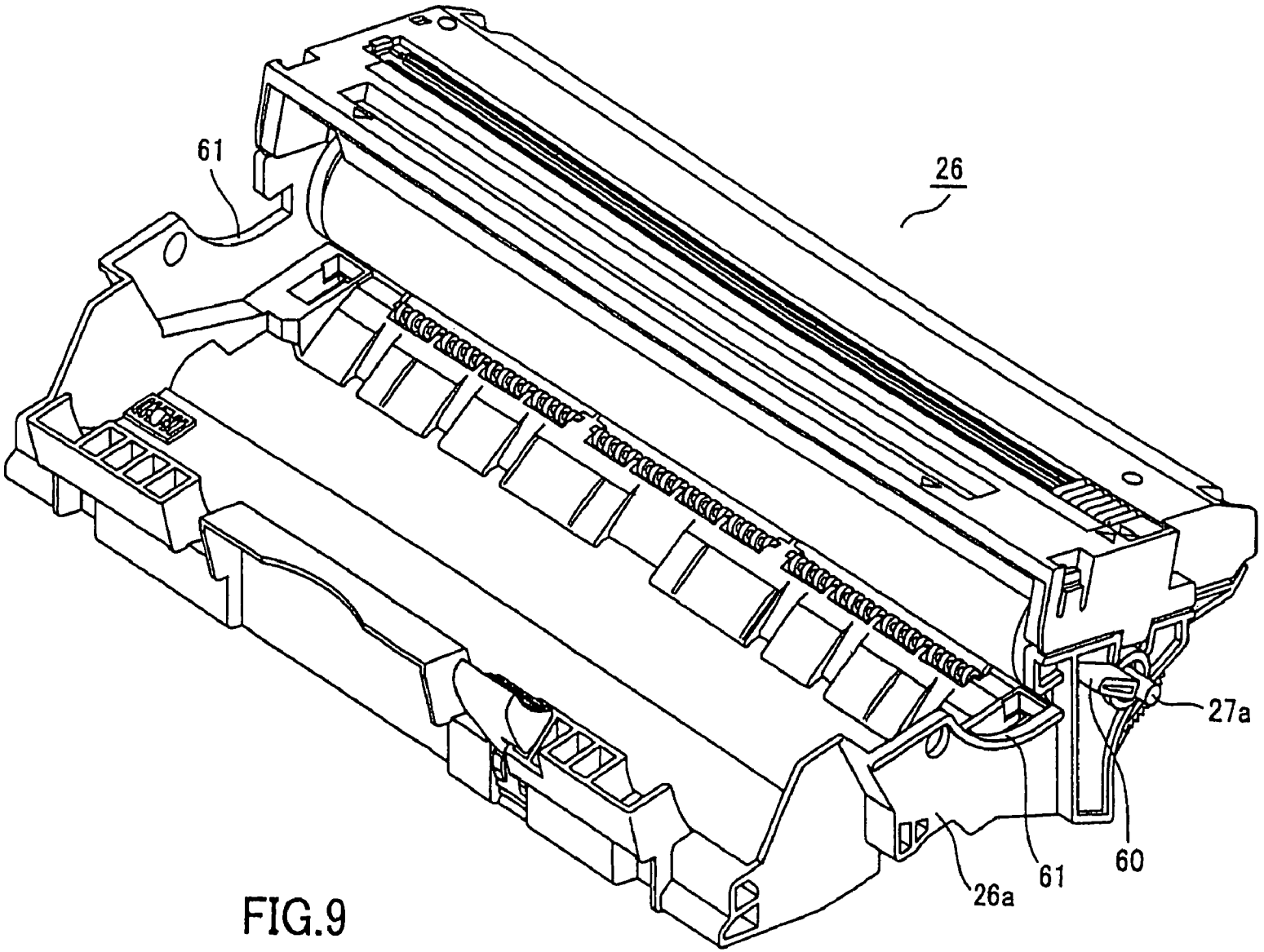
FIG. 9 is a perspective view showing the photosensitive unit.
Figure 10:
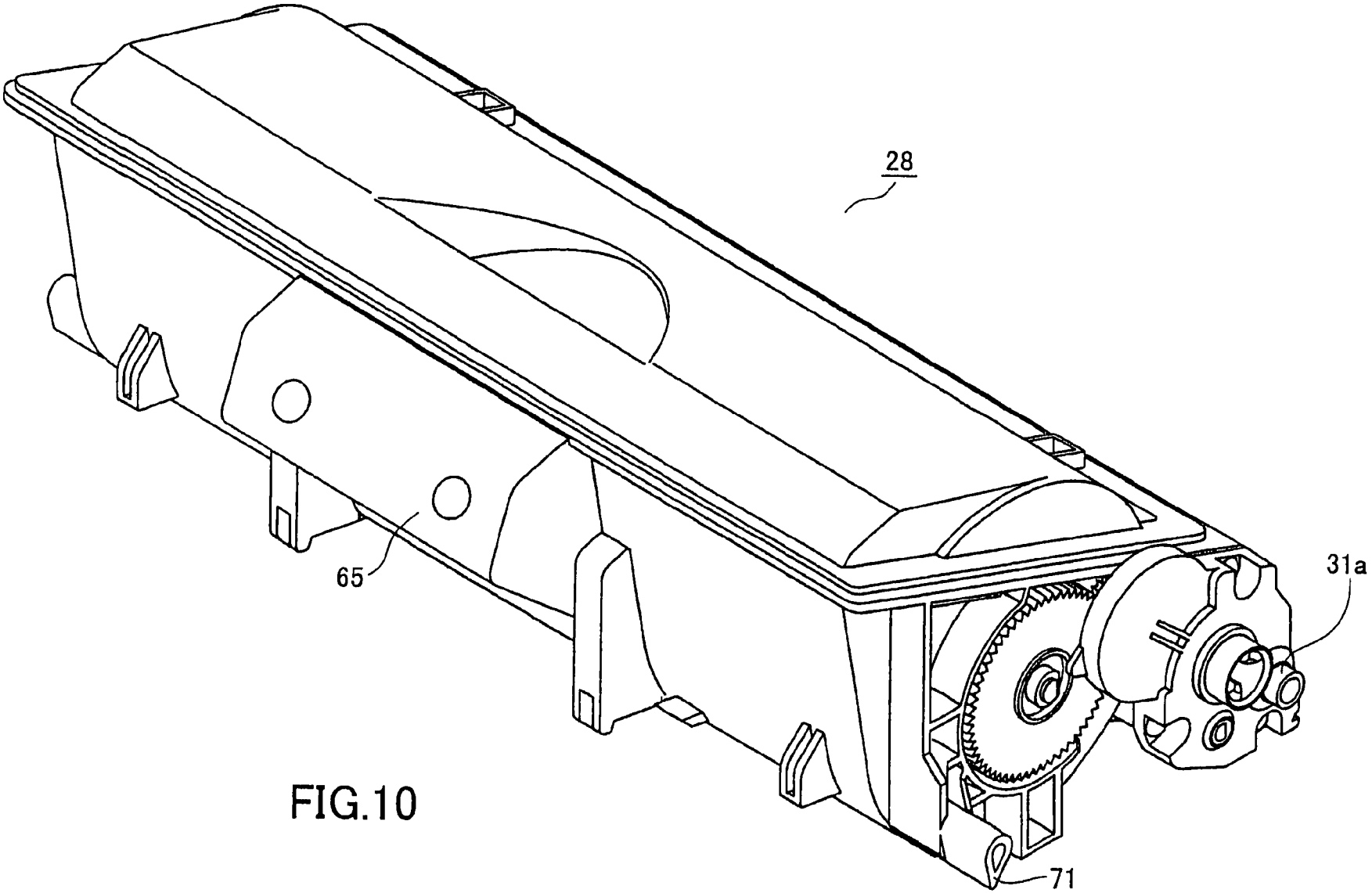
FIG. 10 is a perspective view showing the developing unit.
Figure 11:
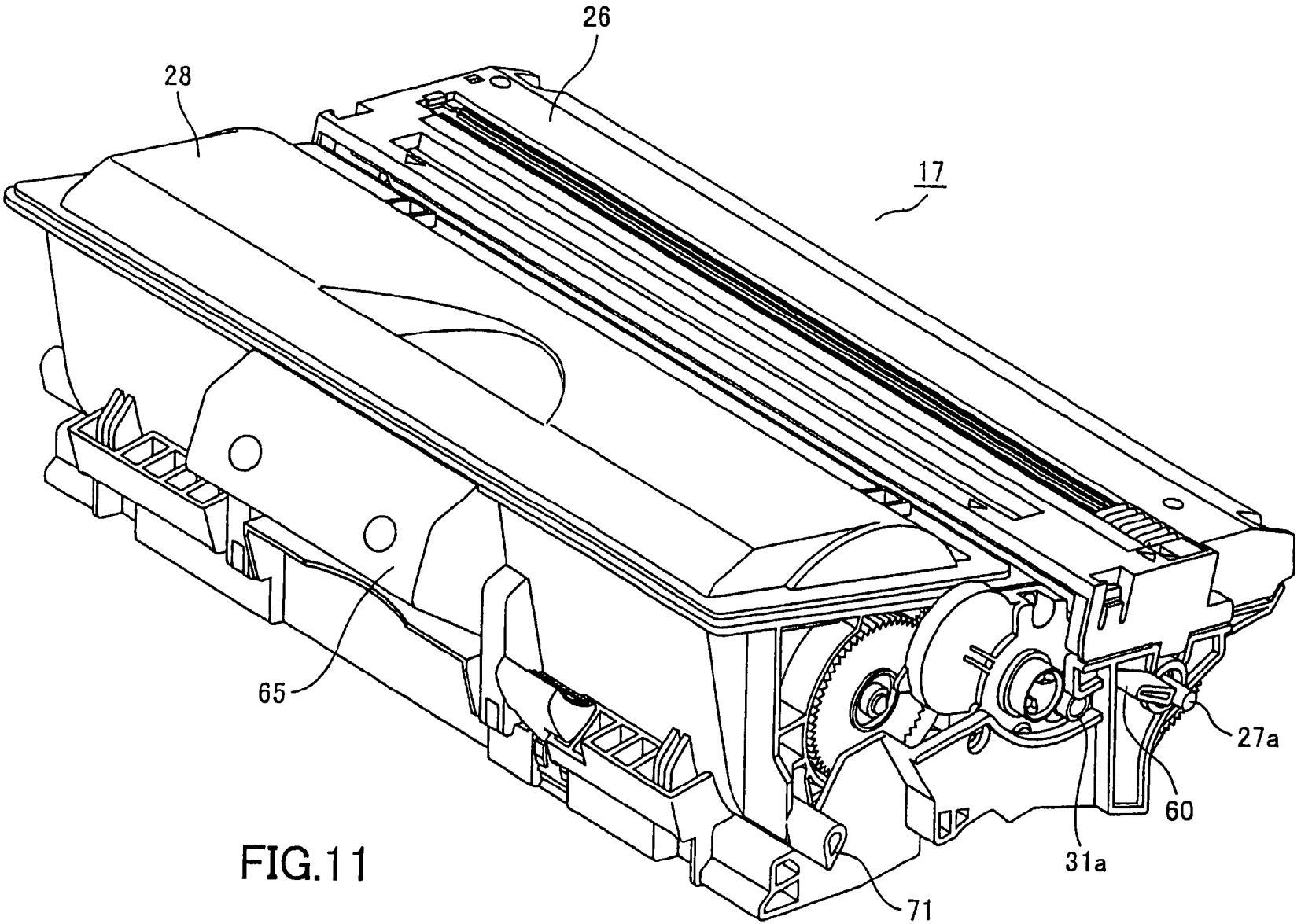
FIG. 11 is a perspective view showing a process unit in which the developing unit shown in FIG. 10 is mounted on and combined to the photosensitive unit shown in FIG. 9.

FIG. 9 shows the photosensitive unit 26 and FIG. 10 shows the developing unit 28. The developing unit 28 is mounted on the photosensitive unit 26 to form the process unit 17 as shown in FIG. 11.

The photosensitive unit 26 has side walls 26*a* apart from each other by a predetermined distance. Both end portions of the rotational shaft 27*a* of the photosensitive drum 27 project out from the side walls 26*a*. A guide plate 60 also projects out from the side wall 26*a* near the rotational shaft 27*a*. The guide plates 60 determine a loading direction of the photosensitive unit 26 or the process unit 17 in cooperation with the rotational shaft 27*a* when the unit 26 or 17 is loaded into the housing 2. The photosensitive unit 26 has a drum unit accommodating section that is defined by the side walls 26*a* and a bridging frame 26*b* bridged between the side walls 26*a* at the developing unit receiving side. The upper surface of the developing unit mounting section is open to allow the developing unit 28 to be mounted thereon. A developing unit guide groove 61 is formed in each side wall 26*a* and is used when the developing unit 28 is mounted on and dismounted from the photosensitive unit 26. In mounting the developing unit 28, it is disposed so that its developing roller side faces the photosensitive unit 26, and then the developing unit 28 is moved toward the photosensitive unit 26. At this time, the developing unit guide groove 61 guides the roller shaft 31*a* of the developing roller 31 until the developing roller 31 is brought into abutment with the photosensitive drum 27. When the developing roller 31 is in abutment with the photosensitive drum 27, the rotational shaft 31*a* of the developing roller 31 is located in a terminal 61*a*, i.e., the end position of the guide groove 61.

As shown in FIG. 3, the developing unit 28 is pivotally movable about the rotational shaft 31*a* in a position where the rotational shaft 31*a* is located in the terminal 61*a*. By rotating the trailing end of the developing unit 28 downward, the developing unit 28 is accommodated into the developing unit mounting section. A support 28*c* formed in the bottom surface of the developing unit 28 is brought into abutment with the surface of the developing unit mounting section and supports the developing unit 28 therein in cooperation with the rotational shaft 31*a* supported on the terminal 61*a*. Likewise, a support 26*d* is formed in the bottom surface of the photosensitive unit 26 in the position where the support 28*c* is seated. The support 26*d* protrudes outwardly, so its inner surface is configured to be concave and capable of receiving the support 28*c*. The developing unit 28 is thus properly positioned on the developing unit mounting section when the support 28*c* is mated with the support 26*d* from the back side.

Figure 8:
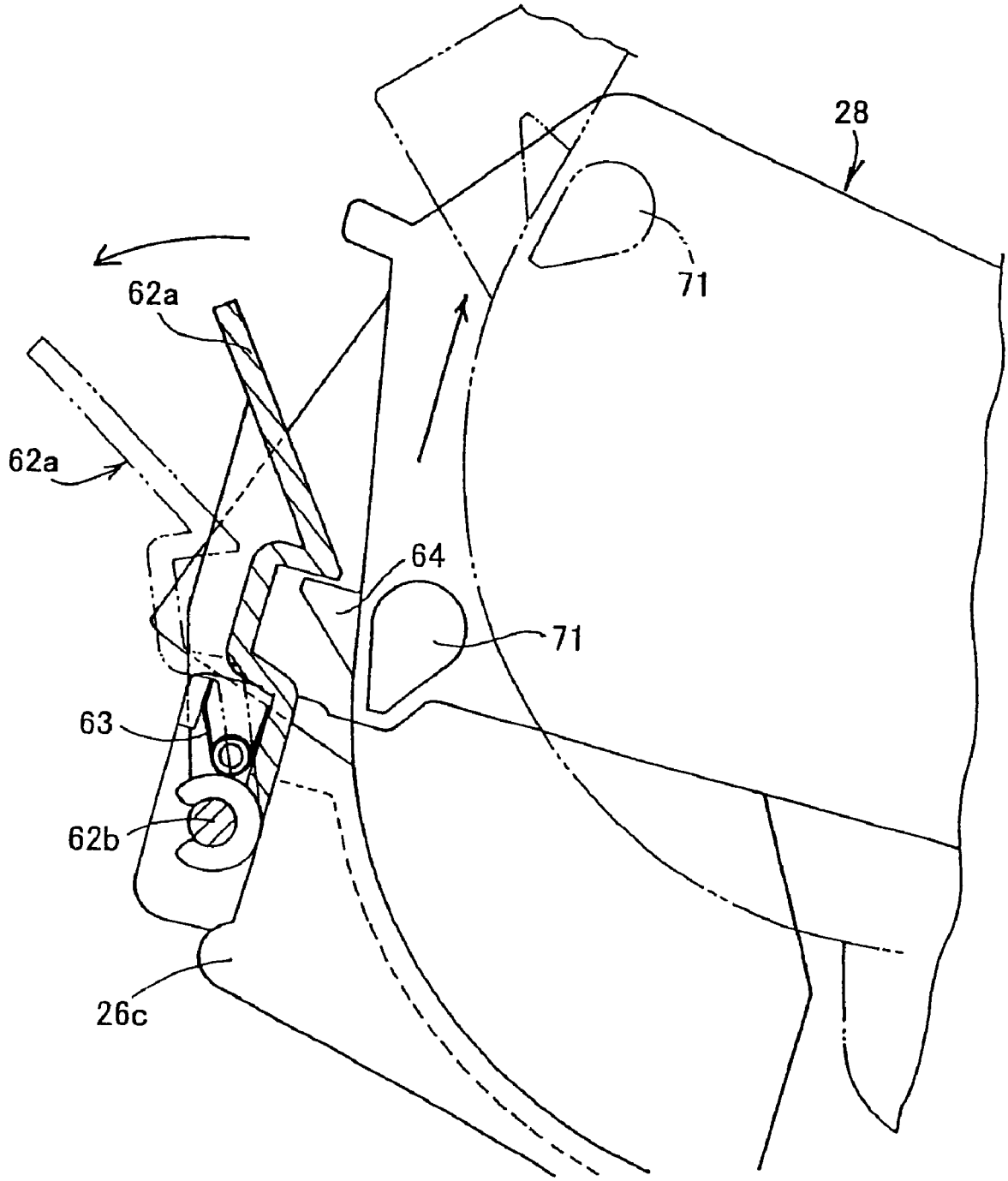
FIG. 8 is an enlarged side view showing a locking mechanism for locking the developing unit to the photosensitive unit.

The bridging frame 26*b* has its outer surface provided with a locking mechanism 62. The locking mechanism 62 includes a locking lever 62*a* which, as shown in FIG. 8, is pivotally movable about a shaft 62*b* formed in the bridging frame 26*b*. The locking lever 62*a* is biased by a torsion spring 63 in a direction in which the locking lever 62*a* engages a locking protrusion 64 formed in the rear end of the developing unit 28. Engaging the locking lever 62*a* with the locking protrusion 64 locks the developing unit 28 to the photosensitive unit 26.

As shown in FIGS. 4, 10 and 11, a gripping portion 65 is provided at the rear side, that is the same side as the side where the locking protrusion 64 is formed, of the developing unit 28 for operator's gripping convenience. The operator can lift the combined developing unit 28 and the photosensitive unit 26, i.e., the process unit 17, while gripping the upper surface of the developing unit 28 and the gripping portion 65. In this case, because engagement of the rotational shaft 31*a* of the developing roller 31 with the terminal 61*a* of the guide groove 61 is being maintained when the developing unit 28 is lifted, the photosensitive unit 26 is not separated from the developing unit 28. In this manner, the developing unit 28 can be mounted on and dismounted from the photosensitive unit 26 regardless of whether the photosensitive unit 26 is loaded in the laser beam printer 1 or the photosensitive unit 26 is placed outside the laser beam printer 1.

As shown in FIGS. 1, 2 and 4, a process cartridge insertion opening is formed in an upper surface of the housing 2 in a position frontwardly of the sheet discharge tray 46. The opening is defined by the front plate 2*a*, left and right side walls 2*b*. A lid 54 that is pivotally movable about a shaft 54*a* covers the opening.

Figure 5:
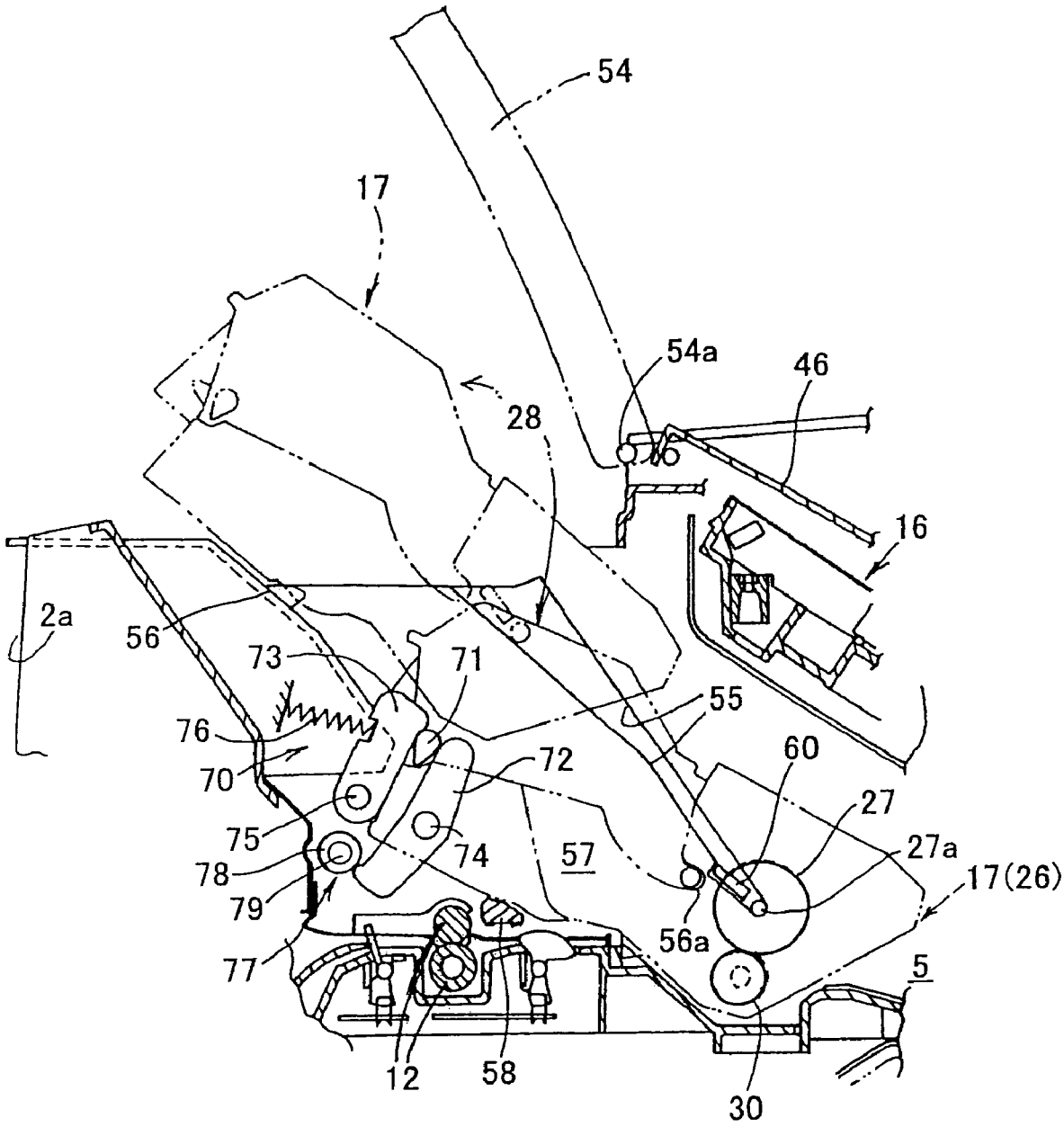
FIG. 5 is a side view showing first guides, second guides, and a pressing mechanism.
Figure 6:
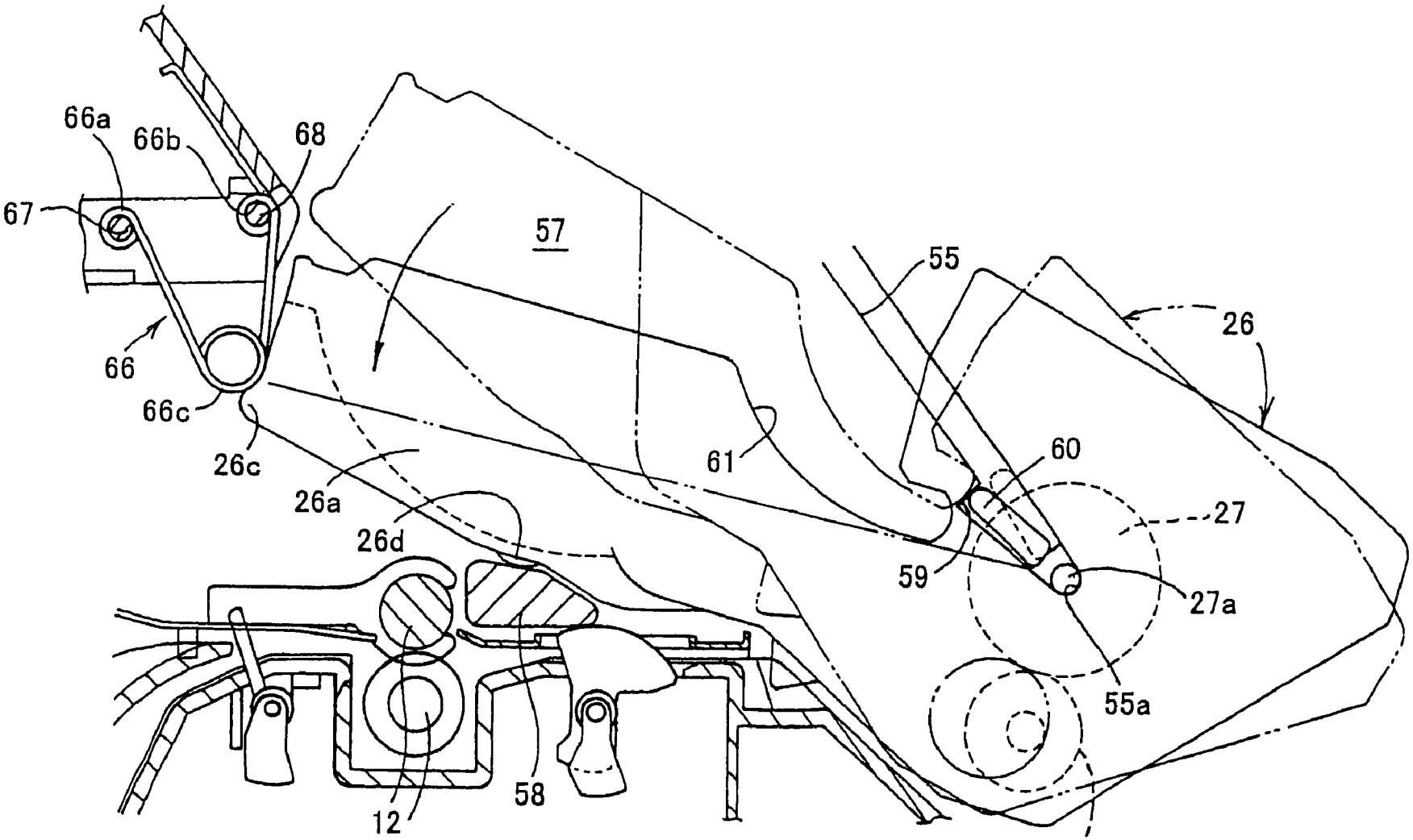
FIG. 6 is a side view showing a locking mechanism for locking the process unit.

As shown in FIGS. 4 and 5, first guides 55 are formed in the inner surfaces of the side walls 2*b* of the housing 2. The first guides 55 are sloped down toward their end positions or terminals 55*a* as shown in FIG. 6. When viewed from the side, the first guide 55 is seen to be an elongated U-shaped groove into which the rotational shaft 27*a* of the photosensitive drum 27 is inserted. The rotational shaft 27*a* of the photosensitive drum 27 is slidably moved down toward the lowest end position, i.e., the terminal 55*a*, of the first guide 55 where the photosensitive drum 27 can be rotatably supported.

A pair of second guides 56 are provided between the first guides 55. Like the first guide 55, the second guide 56 is also sloped down in the same direction as the direction in which the first guide 55 is sloped down. However, unlike the first guide 55, the second guide 56 is in the form of a rail with a flat upper surface, along which the photosensitive unit 26 moves. Between the second guides 56, a photosensitive unit accommodating section 57 is formed for receiving the photosensitive unit 26.

To load the photosensitive unit 26 or the process unit 17 into the laser beam printer 1, the rotational shaft 27*a* of the photosensitive drum 27 is slidably moved down along the first guides 55. When the rotational shaft 27*a* has reached the terminals 55*a* of the first guides 55, the trailing end of the photosensitive unit 26 is rotated downward about the rotational shaft 27*a*. In this manner, the photosensitive unit 26 is placed on the photosensitive unit accommodating section 57.

As shown in FIG. 6, a seat 58 is provided below the photosensitive unit accommodating section 57 for seating the photosensitive unit 26 thereon. When the photosensitive unit 26 is placed on the photosensitive accommodating section 57, a protruded portion 26*d* formed on the bottom wall of the photosensitive unit 26 is brought into abutment with the seat 58. Due to the protruded portion 26*d* and the seat 58, the posture of the photosensitive unit 26 can be maintained on the photosensitive accommodating section 57.

The photosensitive unit 26 is loaded into the laser beam printer 1 in the following manner. First, the photosensitive unit 26 is oriented in a direction in which the photosensitive drum side faces the inner portion of the housing 2. Both end portions of the rotational shaft 27*a* projecting out from the photosensitive unit 26 are inserted into the first guides 55. The guide plates 60 formed next to the rotational shaft 27*a* also slide along the first guides 55 following the rotational shaft 27*a*. The process unit 17 is obliquely downwardly moved into the housing 2. At this time, left and right side portions of the photosensitive unit 26 are disposed on the second guides 56 and are slidably moved down while being guided by the second guides 56.

When the rotational shaft 27*a* has reached the terminal 55*a* of the first guides 55, the photosensitive unit 26 is disengaged from the second guides 56. As a result, the rear end portion of the photosensitive unit 26 rotates downward about the rotational shaft 27*a* and the photosensitive unit 27 is placed on the photosensitive unit accommodating section 57. At this time, the protrusion 26*d* on the bottom surface of the photosensitive unit 26 is brought into abutment with the seat 58. The photosensitive unit 26 is stably supported at three points, that is, left and right sides of the rotational shaft 27*a* and the seat 58.

As shown in FIG. 4, a boss 26*e* is formed on one side wall (right side wall in the figure) of the photosensitive unit 26. An electrically driven urging unit (not shown) disposed in the housing 2 urges the opposite side wall (left side wall in the figure) of the photosensitive unit 26 toward the right side wall so that the boss 26*e* is in abutment with the right side inner surface of the housing 2. A gear (not shown) is provided at the right side of the photosensitive unit 26. The photosensitive unit 26 is urged toward the right side of the housing 2 by the force created by the rotations of the gear. With the electrically driven urging unit and the gear, the photosensitive unit 26 is positioned in the same location on the photosensitive unit accommodating section 57. Similarly, the developing unit 28 is positioned so that the right side of the developing unit 28 is urged in the same direction.

As described, the photosensitive unit 26 is loaded on the photosensitive unit accommodating section 57 by downwardly rotating (counterclockwise direction in FIG. 6) the trailing side about the rotational shaft 27*a* located at the terminal 55*a*. In the positions near the terminals 55*a* of the first guides 55, stepped portions 59 are engraved. When the trailing end of the photosensitive unit 26 is rotated downward about the rotational shaft 27*a*, the guide plates 60 are fitted into the stepped portions 59. Thus, the photosensitive unit 26 cannot easily be taken out from the photosensitive unit accommodating section 57.

Figure 7:
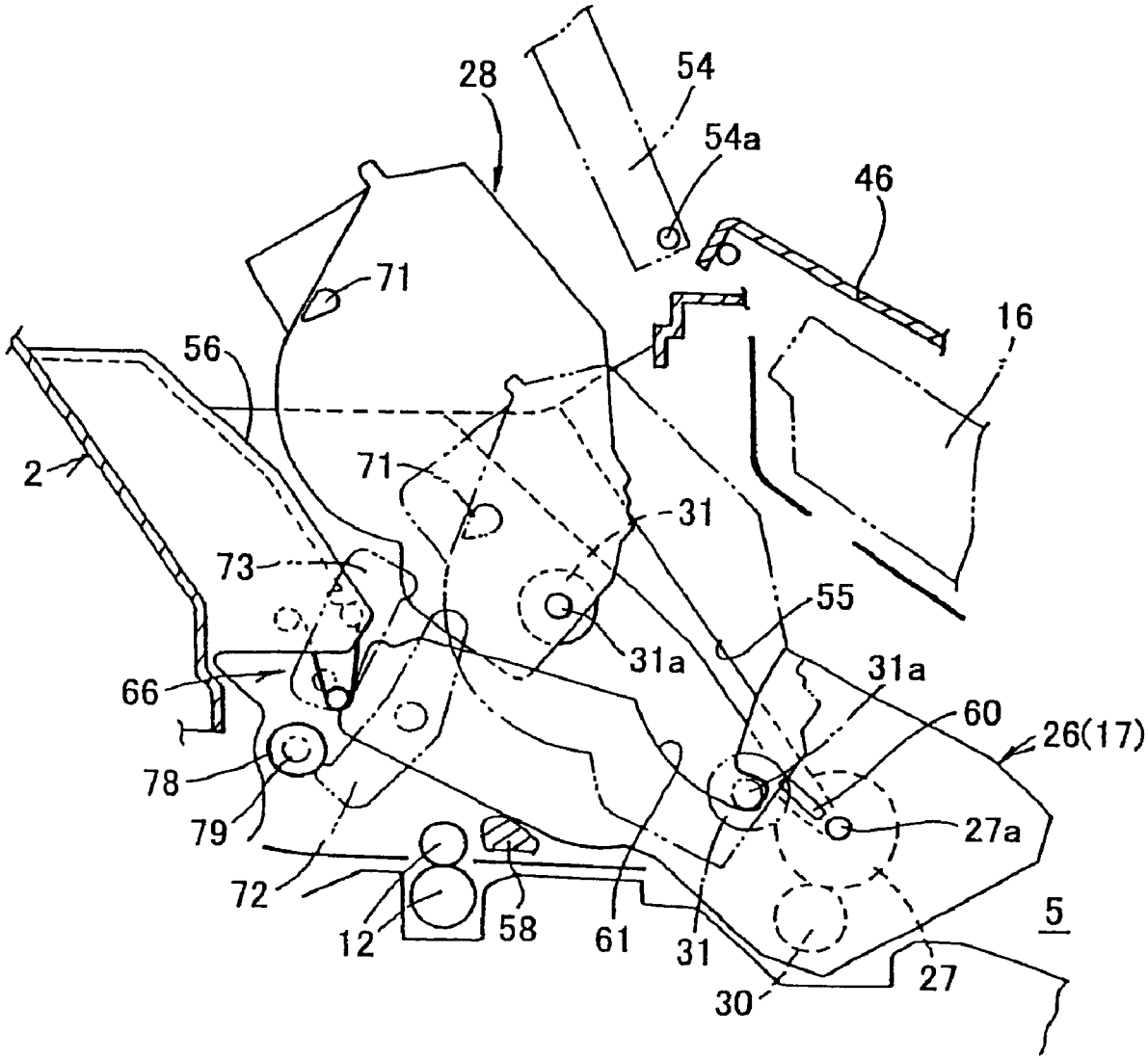
FIG. 7 is a side view showing a process of combining the developing unit to the photosensitive unit loaded into the process unit receiving portion.

As shown in FIGS. 6 and 7, locking units are provided in the photosensitive unit accommodating section 57 at positions beneath the second guides 56. Each locking unit includes a torsion spring 66 having a rounded head 66*c* and a pair of legs extending from the head 66*c*. Ring-shaped foot portions 66*a*, 66*b* are provided at the ends of the legs, which are supported by pins 67, 68, respectively. When the photosensitive unit 26 is accommodated in the photosensitive unit accommodating section 57, the rounded head 66*c* of the torsion spring 66 engages a dimple 26*c* formed in the rear wall of the photosensitive unit 26 and urges the photosensitive unit 26 toward the terminal 55*a* of the first guide 55. By virtue of the urging force of the torsion spring 66, the photosensitive unit 26 is firmly held and supported at three points as mentioned above.

In order to unload the photosensitive unit 26 from the photosensitive unit accommodating section 57, the operator grasps the gripping portion 65 and lifts the photosensitive unit 26. Lifting the photosensitive unit 26 causes the rounded head 66*c* of the torsion spring 66 to disengage from the dimple 26*c*. To completely unload the photosensitive unit 26, the photosensitive unit 26 is further lifted while directing the trailing end upward and slidably moving back the photosensitive unit 26 along the second guides 56. Loading and unloading the photosensitive unit 26 can be performed regardless of whether the developing unit 28 is combined to the photosensitive unit 26. That is, not only the photosensitive unit 26 alone but also the process unit 17 can be loaded into and unloaded from the laser beam printer 1 in such a manner as described above. Another locking unit can be employed instead of the locking unit using the torsion spring 66.

Next, an urging mechanism 70 will be described while referring to FIGS. 4, 5 and 7. The urging mechanism 70 is operable only when the photosensitive unit 26 and the developing unit 28 as combined are loaded into the laser beam printer 1, because the urging mechanism 70 is used for urging the developing roller 31 contained in the developing unit 28 against the photosensitive drum 27 contained in the photosensitive unit 26.

The urging mechanism 70 is disposed in a space between the first guide 55 and the second guide 56, and includes a pair of nipping levers 72, 73 and a lever moving mechanism 77 for moving one nipping lever 73 toward and away from another nipping lever 72. A teardrop-shaped engagement protrusion 71, that is formed in the rear portion of each of the side walls of the developing unit 28, is inserted between the nipping levers 72, 73 when the developing unit 28 is mounted on the photosensitive unit 26. The engagement protrusion 71 is nipped by the nipping levers 72, 73 and is urged toward the terminal 55*a*, so that the developing roller 31 is urged against the photosensitive drum 27.

The nipping levers 72, 73 are supported by pins 74, 75, respectively, and are pivotally movable about the respective pins 74, 75. A spring 76 having one end fixed to the housing 2 and another end fixed to the movable end portion of the nipping lever 73 exerts urging force upon the nipping lever 73. Thus, the nipping lever 73 is rotated counterclockwise and nips the engagement protrusion 71 in cooperation with another nipping lever 73.

The lever moving mechanism 77 includes a cam 78 and a cam shaft 79 to which the cam 78 is fixed. The cam shaft 79 is connected to a motor (not shown) and rotated thereby. The cam 78 is in contact with one end of the nipping lever 72, so that rotations of the cam 78 move opposite ends of the nipping lever 72 toward and away from the movable end of the counterpartnipping lever 73. Instead of moving the cam shaft 79 by the motor, the cam shaft 79 can be moved manually.

The process unit 17 can be loaded into the laser beam printer 1. Also, the developing unit 28 can be separately loaded into the laser beam printer 1 if the photosensitive unit 26 has already been set to the printer 1. In the former case, when the trailing end of the photosensitive unit 26 is rotated downward about the rotational shaft 27*a* with the rotational shaft 27*a* being fitted to the terminals 55*a* of the first guides 55, the engagement protrusion 71 moves downward and is inserted between the pair of nipping levers 72, 73 against the urging force of the spring 76 urging the nipping lever 73 toward the counterpart nipping lever 72. At this time, the upper end of the nipping lever 72 has been moved toward the free end of the nipping lever 73. In this case, the engagement protrusion 71 moves downward and is inserted between the pair of nipping levers 72, 73 when the trailing end of the loaded developing unit 28 is rotated downward about the roller shaft 31*a* located in a terminal 56*a* of the guide groove 61.

As shown in FIG. 5, when the photosensitive unit 26 is accommodated in the photosensitive unit accommodating section 57, the roller shaft 31*a* of the developing roller 31 is located in the terminal 56*a* of the guide groove 61 formed in the side wall of the photosensitive unit 26. In this condition, the roller shaft 31*a* is on or along the line connecting the rotational shaft 27*a* of the photosensitive drum 27 and the engagement protrusion 71. Therefore, the engagement protrusion 71 traces substantially the same locus at the time of downward movement of the process unit 17 and of downward movement of only the developing unit 28. Therefore, not only the process unit 17 but also the developing unit 28 alone can be loaded into and unloaded from the printer 1 as shown by two-dotted-chain line in FIG. 7.

When the photosensitive unit 26 is unloaded from the photosensitive unit accommodating section 57, the photosensitive unit 26 is not capable of rotating about the rotational shaft 27*a* in the unloading direction more than a limited extent due to the guide plate 60. Accordingly, the upper portion of the photosensitive unit 26 does not impinge upon the lower cover of the scanner unit 16, so the scanner unit 16 or other components are not damaged.

At the time of printing, the motor is driven by a controller (not shown) to thereby rotate the cam 78. Abutment of the small-diameter portion of the cam 78 with the lower portion of the nipping lever 72 moves the upper portion of the nipping lever 72 toward the photosensitive drum 27. On the other hand, the nipping lever 73 urges the engagement protrusion 71 toward the photosensitive drum 27 by the urging force of the spring 76. As a result, the developing roller 31 is urged against the peripheral surface of the photosensitive drum 27.

When the printing operation is not performed, the large-diameter portion of the cam 78 is brought into abutment with the lower portion of the nipping lever 72, thereby moving the upper portion of the nipping lever 72 away from the photosensitive drum 27. Accordingly, the engagement protrusion 71 is moved toward the nipping lever 73 and so the developing unit 28 is separated from the photosensitive drum 27.

As described above, the developing unit 28 and the photosensitive unit 26 can be combined into a single unit outside the printer 1. This can be done outside the printer 1 by inserting the developing unit 28 into the guide groove 61 of the photosensitive unit 26 and mounting the developing unit 28 on the developing unit mounting section of the photosensitive unit 26. The combined unit (process unit) can also be easily loaded into and unloaded from the laser beam printer 1. Furthermore, only the developing unit 28 can be loaded into the laser beam printer 1, mounted on the photosensitive unit 26 that has already been set in position in the laser beam printer 1, and dismounted from the photosensitive unit 26 while leaving the photosensitive unit 26 inside the laser beam printer 1.

The roller shaft 31*a* of the developing roller 31 and the rotational shaft 27 of the photosensitive drum 27 protrude out from the units 26 and 28, respectively, and are rotated by a drive motor (not shown) disposed in the housing 2 via couplings and a transmission gear mechanism. Counterclockwise rotational moments (FIG. 2) imparted upon the roller shaft 31*a* and the rotational shaft 27 (the rotational moments imparted toward the bottom of the photosensitive unit accommodating section 57) cause the photosensitive unit 26 and the developing unit 28 to move toward their accommodating sections. Accordingly, by utilizing the rotational moments of the roller shaft 31*a* and the rotational shaft 27 and also owing to the weights of the units 26, 28, mounting the units 26, 28 on their accommodating sections can be performed smoothly.

As shown in FIG. 4, a latching mechanism is provided to latch the process unit 17 to the photosensitive unit accommodating section 57. Specifically, a protrusion 80 is formed on the photosensitive unit accommodating section 57. An engaging portion 81 is formed on the bottom surface of the process unit 17 in the position corresponding to the position of the protrusion 80. When the process unit 17 is placed on the photosensitive unit accommodating section 57, the engaging portion 81 is brought into engagement with the protrusion 80. By the provision of the engaging portion 81 in the process unit 17, an improper process unit with no such protrusion 80 or with the protrusion 80 in a position offset from the correct position is not allowed to be properly accommodated in the photosensitive unit accommodating section 57. That is, the protrusion 80 serves as a discriminating member for discriminating a type of process unit 17. The discriminating member is used by an image forming device to determine if a process unit 17 loaded thereinto is proper or not. In a modification, the protrusion 80 may be formed in the bottom surface of the process unit 17 and the engaging portion 81 for receiving the protrusion 80 may be formed in the photosensitive unit accommodating section 57.

While the invention has been described in detail with reference to specific embodiments thereof, it would be apparent to those skilled in the art that various changes and modifications may be made therein without departing from the spirit of the invention, the scope of which is defined by the attached claims.

For example, instead of using the rotational shaft of the photosensitive drum as a guide shaft for loading the photosensitive unit into the printer, a pair of protrusions may be formed on outer surfaces of the side walls for use as the guide shaft. In this case, it is desirable that the protrusions be in alignment with the longitudinal axis of the shaft. The same is true with respect to the guide shaft for mounting the developing unit on the photosensitive unit.

What is claimed is:

1. An image forming device comprising:

a housing;

a separation mechanism mounted on the housing;

a photosensitive unit including a photosensitive drum and a guide groove; and a developing unit including:

a developing roller having a shaft; and a case accommodating the developing roller therein, wherein the developing unit is movable along the guide groove, wherein the developing unit is attachable and detachable from the photosensitive unit, the guide groove being structured to guide the developing roller into contact with the photosensitive drum when the developing unit is mounted on the photosensitive unit and the shaft is moved along the guide groove toward the photosensitive drum, and to guide the developing roller away from the photosensitive drum when the shaft is moved along the guide groove away from the photosensitive drum by the separation mechanism.

2. The image forming device according to claim 1, wherein the photosensitive unit and the developing unit form a combined unit, the combined unit being detachable from the housing.

3. The image forming device according to claim 1, wherein:

the case is formed with a protrusion protruding in a direction parallel to the shaft of the developing roller, and the protrusion is engageable with the separation mechanism to separate the developing roller from the photosensitive drum.

4. The image forming device according to claim 3, wherein the separation mechanism includes:

a first nipping member; and a second nipping member, the first nipping member and the second nipping member being configured to nip the protrusion, the first nipping member being selectively positioned to one of a first position and a second position, wherein the developing roller is separated from the photosensitive drum when the first nipping member is positioned at the first position.

5. The image forming device according to claim 4, further comprising an urging member that urges the second nipping member toward the protrusion to thereby urge the developing roller against the photosensitive drum.

6. The image forming device according to claim 5, wherein the developing roller contacts the photosensitive drum when the first nipping member is positioned at the second position.

7. The image forming device according to claim 6, wherein the separation mechanism includes a cam mechanism that selectively positions the first nipping member to either the first position or the second position.

8. The image forming device according to claim 6, wherein:

the developing unit has a pair of first side walls, each of the pair of first side walls being formed with the protrusion, the housing has a pair of second side walls, each of the pair of second side walls opposing each of the pair of first side walls, the first nipping member and the second nipping member being provided on each of the pair of second side walls, and the first nipping member and the second nipping member nip the protrusion formed in each of the pair of first side walls in cooperation with the urging member.

9. An image forming device comprising:

a housing;

a separation mechanism mounted on the housing;

a photosensitive unit including a photosensitive drum and a guide groove; and a developing unit formed with a first protrusion, including:

a developing roller having a shaft, the first protrusion protruding in a direction parallel to the shaft; and a case accommodating the developing roller therein, wherein the developing unit is movable along the guide groove, wherein the developing unit is attachable to and detachable from the photosensitive unit, the guide groove being structured to guide the developing roller into contact with the photosensitive drum when the developing unit is mounted on the photosensitive unit and the first protrusion is moved along the guide groove toward the photosensitive drum, and to guide the developing roller away from the photosensitive drum when the first protrusion is moved along the guide groove away from the photosensitive drum by the separation mechanism.

10. The image forming device according to claim 9, wherein the photosensitive unit and the developing unit form a combined unit, the combined unit being detachable from the housing.

11. The image forming device according to claim 10, wherein:

the case is formed with a second protrusion protruding in a direction parallel to the shaft of the developing roller, and the second protrusion is engageable with the separation mechanism to separate the developing roller from the photosensitive drum.

12. The image forming device according to claim 11, wherein the separation mechanism includes:

a first nipping member; and a second nipping member, the first nipping member and the second nipping member being configured to nip the second protrusion, the first nipping member being selectively positioned to one of a first position and a second position, wherein the developing roller is separated from the photosensitive drum when the first nipping member is positioned at the first position.

13. The image forming device according to claim 12, further comprising an urging member that urges the second nipping member toward the second protrusion to thereby urge the developing roller against the photosensitive drum.

14. The image forming device according to claim 13, wherein the developing roller contacts the photosensitive drum when the first nipping member is positioned at the second position.

15. The image forming device according to claim 14, wherein the separation mechanism includes a cam mechanism that selectively positions the first nipping member to either the first position or the second position.

16. The image forming device according to claim 14, wherein:

the developing unit has a pair of first side walls, each of the pair of first side walls being formed with the second protrusion, the housing has a pair of second side walls, each of the pair of second side walls opposing each of the pair of first side walls, the first nipping member and the second nipping member being provided on each of the pair of second side walls, and the first nipping member and the second nipping member nip the protrusion formed in each of the pair of first side walls in cooperation with the urging member.

17. The image forming device according to claim 9, wherein the shaft of the developing roller serves as the first protrusion.

* * * * *